US005215126A

United States Patent [19]

Clark

[11] Patent Number: 5,215,126

[45] Date of Patent: Jun. 1, 1993

[54] INSULATION SHEATHS

[75] Inventor: Michael R. Clark, Stourbridge, England

[73] Assignee: Foseco International Limited, Birmingham, England

[21] Appl. No.: 649,051

[22] Filed: Feb. 1, 1991

[30] Foreign Application Priority Data

Feb. 8, 1990 [GB] United Kingdom ..... 9002821

[51] Int. Cl.[5] ..... F27D 9/00

[52] U.S. Cl. ..... 138/149; 138/155; 432/234

[58] Field of Search ..... 138/149, 140, 141, 156, 138/157, 155, 172, 177, 174, 101; 432/233, 234

[56] References Cited

U.S. PATENT DOCUMENTS

| | | | |
|---|---|---|---|
| 3,157,204 | 11/1964 | Phillips | 138/149 |
| 3,226,101 | 12/1965 | Balaz et al. | 432/234 |
| 3,486,533 | 12/1969 | Doherty et al. | 138/149 |
| 3,628,572 | 12/1971 | Shannon | 138/149 |
| 4,015,636 | 4/1977 | Van Fossen | 138/149 |
| 4,063,344 | 12/1977 | Jones et al. | 138/149 |
| 4,155,377 | 5/1979 | Suzuki et al. | 138/149 |
| 4,228,826 | 10/1980 | Campbell | 138/149 |
| 4,304,267 | 12/1981 | Campbell | 138/149 |
| 4,310,585 | 1/1982 | Shannon | 138/149 |
| 4,363,504 | 12/1982 | De Feo et al. | 138/149 |
| 4,393,569 | 7/1983 | Byrd | 138/149 |
| 4,397,338 | 8/1983 | Cunningham | 138/145 |
| 4,432,396 | 2/1984 | Daussan et al. | 138/149 |
| 4,450,872 | 5/1984 | Orcutt | 138/149 |
| 4,677,731 | 7/1987 | Sommerer et al. | 138/149 |
| 4,966,201 | 10/1990 | Svec et al. | 138/149 |

FOREIGN PATENT DOCUMENTS

| | | | |
|---|---|---|---|
| 2623197 | 12/1977 | Fed. Rep. of Germany | 432/234 |
| 0158722 | 12/1979 | Japan | 138/149 |
| 38172 | 10/1923 | Norway | 138/149 |
| 1175562 | 12/1969 | United Kingdom . | |
| 1318352 | 5/1973 | United Kingdom . | |
| 1342891 | 1/1974 | United Kingdom . | |
| 1369283 | 10/1974 | United Kingdom . | |
| 1428336 | 3/1976 | United Kingdom . | |
| 1441915 | 7/1976 | United Kingdom . | |
| 1442784 | 7/1976 | United Kingdom . | |
| 1442921 | 7/1976 | United Kingdom . | |
| 1468177 | 3/1977 | United Kingdom . | |
| 1482623 | 8/1977 | United Kingdom . | |
| 1528865 | 10/1978 | United Kingdom . | |
| 1558475 | 1/1980 | United Kingdom . | |
| 1590449 | 6/1981 | United Kingdom . | |
| 2092258 | 8/1982 | United Kingdom . | |
| 2118283 | 10/1983 | United Kingdom . | |
| 2125926 | 3/1984 | United Kingdom . | |

*Primary Examiner*—James E. Bryant, III
*Attorney, Agent, or Firm*—Nixon & Vanderhye

[57] ABSTRACT

An insulation sheath for a pipe in a furnace is provided. The sheath has excellent insulation properties together with adequate resistance to the corrosive environment and thermal shock conditions. A pre-formed, substantially C-shaped, elongate member shaped to conform to the pipe over a portion of its circumference, the member comprising an inner layer of bonded insulating material integrally-bonded to a protective outer layer of refractory material. The inner layer is preferably formed of bonded ceramic fibre.

17 Claims, 1 Drawing Sheet

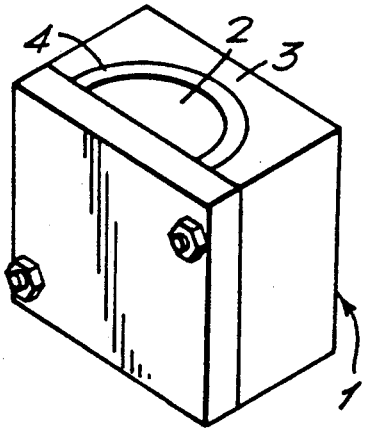
FIG.1.
FIG.2.
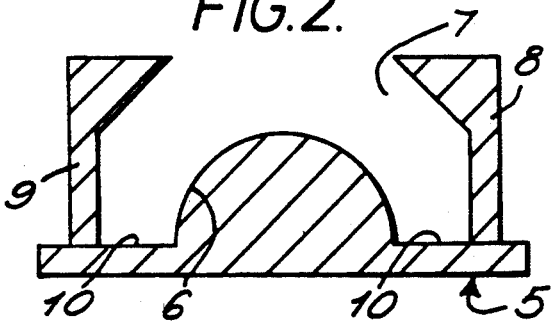
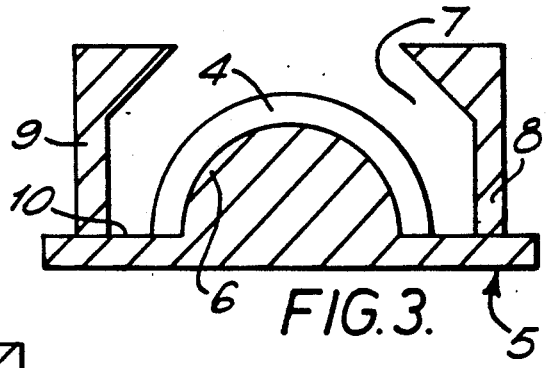
FIG.3.
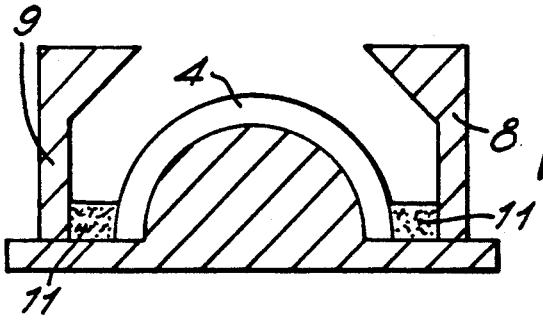
FIG.4.
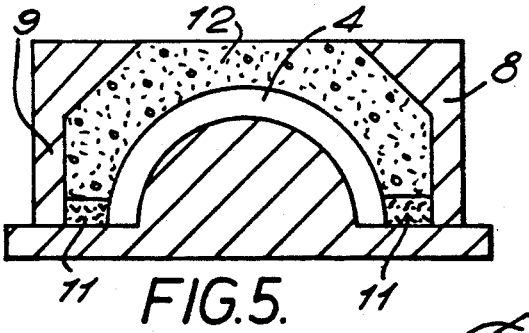
FIG.5.
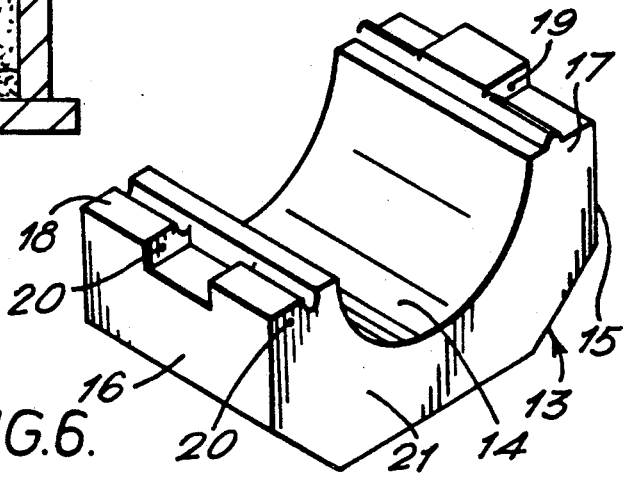
FIG.6.

INSULATION SHEATHS

This invention relates to insulation sheaths and particularly to sheaths for the insulation of tubes, pipes or the like in furnaces.

It is well known that reheat furnaces, e.g. pusher furnaces and walking beam furnaces, and the like, require water-cooled supports. Such supports, which may be in the form of hollow tubes or pipes, require insulation to protect them from the heat and also to reduce the otherwise high heat losses that would be incurred by the cooling effect of uninsulated pipes on the material being treated in the furnace.

The insulation is normally provided in the form of one or more layers of sheathing of suitable insulating material which form a jacket or jackets around the pipe to be protected.

It has been proposed to insulate such pipes by a variety of means and these normally take the form of pairs of pre-formed elongate complementary half shells or sheaths which, together, enclose the pipe. A number of pairs are required to cover the longitudinal extent of the pipe.

It will be appreciated that the insulating sheaths must not only have the required insulation properties but they must be resistant to the hot corrosive environment of a reheat furnace and also to the thermal shock that the furnace treatment cycle necessarily entails.

The conflicting requirements of the ideal sheath have conventionally been met, as far as has hitherto proved possible, by the provision of a composite insulation having an inner lining of refractory fibrous material and a thicker outer layer of denser refractory concrete of higher thermal mass than the fibrous layer. The fibrous layer, therefore, provides the basic thermal insulation effect and the other layer, while not being such a good insulator, provides the physical and environmental protection for the unit.

In order to obtain satisfactory products of this nature, various means of attaching the fibrous layer to the outer shell and both to the pipe have been proposed and the assembly of a suitable product can be complicated and time consuming.

The present invention aims to provide an improved insulation sheath that gives excellent insulation properties with relative simplicity of design and manufacture and ease of installation.

Accordingly, the present invention in a first aspect provides an insulation sheath for a pipe, in the form of a pre-formed, substantially C-shaped, elongate member, shaped to conform to the pipe over a portion of its circumference, the member comprising an inner layer of bonded insulating material, the inner layer being integrally bonded to a protective outer layer of refractory material.

Preferably the outer layer is a castable material. It will normally be of greater density than the insulating inner layer.

By "insulating material" of the inner layer is meant a material containing either fibre or aggregates together with one or more binders and which can be cast or vacuum-formed to a pre-form shape and which has the required insulation properties. For example, such materials having a bulk density of less than 1.46 g/cm$^3$ (and a true porosity of over 45%) are commonly classed as insulating.

Preferably the insulating material is of bonded ceramic fibre, e.g. aluminosilicate fibres bonded with colloidal silica and/or colloidal alumina.

The appropriate density and desired insulation properties may be achieved by the incorporation of suitable amounts of aggregate whose granular constituents are cellular.

Thus, the inner layer provides the basic insulating properties required for the product whereas the principal function of the outer layer is to provide the necessary physical strength and environmental protection in the demanding service conditions to which the products are subjected.

The outer layer may, therefore, be made of any suitable refractory castable material capable of withstanding the operating temperatures, which may be 1200° C. to 1300° C. or even higher. These castable materials are normally based on similar aggregates to those of the inner layer and may be, for example, aluminosilicates, magnesite, alumina, silica, zirconia, silicon carbide and boron nitride, and a refractory binder. High alumina cement is a particularly preferred binder. The binder may be present in an amount of up to 35% by weight of the refractory castable material and is preferably present in an amount from 5% to 25% by weight.

The aggregate or filler used in the outer layer refractory castable material will normally have solid, i.e. non-cellular, granular structure and the density of the outer layer will normally be at least 2.0 g/cm$^3$, e.g. from 2.0 to 3.0 g/cm$^3$. However, for certain thermal property requirements, the outer layer may need to have greater insulating properties such that, for example, its density could be as low as 1.0 g/cm$^3$. To achieve this, it may, therefore, be necessary that the granular structure used be cellular.

The invention provides an insulation sheath of excellent insulation properties that can well withstand the rigorous furnace service conditions and in which the detailed formulations of the inner and outer layers can readily be modified by the skilled man of the art to meet particular envisaged conditions. The sheaths can be manufactured by a convenient casting process and much of the complexity of composite assembly of prior art products is eliminated.

Accordingly, in a further aspect, the invention provides a method of making an insulation sheath in which a first layer of insulating material is cast or vacuum-formed and positioned over an elongate substantially C-shaped former in a mould, a second layer of refractory material is formed over the first layer, and the second layer is set.

On removal from the mould and stripping from the former, the product is an elongated, one-piece, substantially C-shaped insulation sheath having an inner (first) layer of insulating material and an outer (second) layer of refractory material, the two layers being integrally bonded together.

Preferably the second layer is cast over the set first layer.

Conveniently, the C-shaped former will be semi-cylindrical so that the resulting products are semi-cylindrical and pairs of substantially identical sheaths can be used to completely encase a pipe of dimensions corresponding to the former used.

The thickness of the layers will depend on the degree of insulation and protection required and the specific materials employed but, as an example, the sheath may have an inner layer thickness of 5 to 25 mm and an outer layer thickness of 15 to 75 mm.

The longitudinal edges of the sheaths may be provided with interlocking means to engage with the corresponding edges of the other half of each pair of sheaths so that good engagement is obtained between the pairs to maintain the insulation effect at the longitudinal joints. The joints may be tongue and groove or intermittent blocks and recesses or combinations of these or any other convenient means.

A number of pairs of sheaths will normally be employed along the length of a pipe and adjacent pairs may abut or also have interlocking means.

The interlocking means, whether longitudinal or transverse, may conveniently be integrally-formed during the casting process by appropriate mould design.

In a preferred embodiment of the invention, the outer layer sheath is integrally-formed reinforced with steel needles. These are preferably located in the region of the outer layer adjacent its longitudinal edges, i.e. at the ends of the arms of the C' and this can be readily achieved by appropriate modification of the casting process as will be described in more detail below. Alternatively, the steel needle reinforcement may be distributed through-out the entire thickness of the outer layer.

The invention is illustrated by way of example only by reference to the accompanying drawings in which is shown the steps in the manufacture of an insulation sheath suitable for a vertically-disposed pipe.

FIG. 1 is an elevation showing the first layer of insulating material formed in a first mould;

FIG. 2 is a transverse section through a second mould which is to receive the first layer formed in the mould of FIG. 1;

FIG. 3 is a similar section through the mould of FIG. 2 after the first layer of insulating material from FIG. 1 has been placed in it;

FIG. 4 is a similar section showing the next stage of the process in which steel needle reinforced refractory material partially fills the remainder of the mould;

FIG. 5 is a similar section showing the mould now filled with refractory castable material; and FIG. 6 is an elevation of an insulation sheath after extraction from the mould.

In FIG. 1, mould 1 has an elongate central semi-cylindrical former 2 and corresponding outer part 3. Parts 2 and 3 define a mould cavity corresponding to the desired first layer 4 of insulating material which is shown formed in the mould. This may be achieved by casting or vacuum-forming.

The set layer 4 is removed from mould 1 and introduced into a second mould 5. Mould 5 is shown in FIG. 2. It has an elongate semi-cylindrical former 6 corresponding to layer 4 and a cavity 7 defined by removable walls 8 and 9 and base 10.

In the next step of the method the layer 4 of insulating material is positioned over former 6 as shown in FIG. 3. The remaining base 10 of the mould is then covered with a refractory castable material 11 containing steel needle reinforcements to a height part way up walls 8 and 9. (FIG. 4). The remainder of the mould cavity 7 is then filled with unreinforced refractory castable material 12 (FIG. 5). When the product is set, walls 8 and 9 are removed and the finished product is stripped from the former 6.

The product is shown in FIG. 6. It is an insulation sheath 13 having a semi-cylindrical concave inner face 14 adapted to fit snugly against a pipe and having walls 15 and 16, the outer extremities 17 and 18 of which are steel reinforced. The walls are conveniently moulded to contain through holes 19 and 20 formed to accommodate fixing pins (not shown) when pairs of the sheaths are located together to encase completely a portion of a length of pipe to be insulated. A series of such pairs of sheaths can then 'sit' one on top of the other with their end faces 21 in abutment to insulate a full length of a vertically-extending pipe.

Sheaths of the invention may also be used to insulate horizontally-disposed furnace pipes. In pusher furnaces, for example, pipes are welded or otherwise attached along the length of horizontal rails or riders. Normally, the rail or rider will sit on top of the pipe to which it is attached. It will be appreciated, therefore, that the insulating sheath cannot (and must not) completely encompass the pipe but its ends can abut either side of the rail or rider.

A sheath for such a pipe may also conveniently be moulded in two complementary halves that can be suspended around the pipe by means, for example, of integrally-formed holes in which pins welded or otherwise attached to the pipe or rail can be located.

In an alternative embodiment, attachment means e.g. of metal, can be moulded into the sheath during its manufacture.

I claim:

1. An insulation sheath for a pipe, the sheath being a substantially C-shaped, elongate member shaped to conform to the pipe over a portion of its circumference, the member consisting of two layers, an inner layer and a protective outer layer integrally-bonded together, the inner layer being formed of bonded insulating material and the outer layer being formed of castable refractory material comprising refractory aggregate and a binder.

2. An insulation sheath according to claim 1, in which the insulating material of the inner layer has a bulk density of less than 1.46 g/cm$^3$ and a true porosity of over 45%.

3. An insulation sheath according to claim 1, in which the insulating material of the inner layer is of bonded ceramic fibre.

4. An insulation sheath according to claim 3, in which the bonded ceramic fibre is aluminosilicate fibre bonded with a binder selected from colloidal silica and colloidal alumina.

5. An insulation sheath according to claim 1, in which the castable material is selected from the group consisting of aluminosilicate, magnesite, alumina, silica, zirconia, silicon carbide and boron nitride aggregate together with a binder.

6. An insulation sheath according to claim 5, in which the binder is high alumina cement.

7. An insulation sheath according to claim 5, in which the binder is present in an amount of up to 35% by weight of the refractory castable material.

8. An insulation sheath according to claim 1, in which the density of the outer layer is from 2.0 to 3.0 g/cm$^3$.

9. An insulation sheath according to claim 1, in which the refractory material of the outer layer includes cellular aggregates and the outer layer has a density of from 1.0 to 2.0 g/cm$^3$.

10. An insulation sheath according to claim 1, in which the outer layer is reinforced with steel needles.

11. An insulation sheath according to claim 10, in which the steel needles are concentrated at the extremities of the arms of the C-shaped outer layer.

12. An insulation sheath according to claim 2, in which the density of the outer layer is from 2.0 to 3.0 g/cm$^3$.

13. An insulation sheath according to claim 2, in which the refractory material of the outer layer includes cellular aggregates and the outer layer has a density of from 1.0 to 2.0 g/cm$^3$.

14. An insulation sheath for a pipe, the sheath being a substantially C-shaped, elongate member shaped to conform to the pipe over a portion of its circumference, the member comprising an inner layer and a protective outer layer integrally-bonded together, the inner layer being formed of bonded insulating material and the outer layer being formed of refractory material reinforced with steel needles concentrated at the extremities of the arms of the C-shaped outer layer.

15. An insulation sheath according to claim 14, in which the insulating material of the inner layer has a bulk density of less than 1.46 g/cm$^3$ and a true porosity of over 45%.

16. An insulation sheath according to claim 14, in which the density of the outer layer is from 2.0 to 3.0 g/cm$^3$.

17. An insulation sheath according to claim 14, in which the refractory material of the outer layer includes cellular aggregates and the outer layer has a density of from 1.0 to 2.0 g/cm$^3$.

* * * * *